United States Patent [19]

Zanasi

[11] 4,116,247

[45] Sep. 26, 1978

[54] DOSING DEVICE

[75] Inventor: Luciano Zanasi, Bologna, Italy

[73] Assignee: Zanasi Nigris S.p.A., Bologna, Italy

[21] Appl. No.: 774,348

[22] Filed: Mar. 4, 1977

[30] Foreign Application Priority Data

Mar. 5, 1976 [IT] Italy ..... 12515 A/76

[51] Int. Cl.[2] ..... B65B 1/24

[52] U.S. Cl. ..... 141/392; 73/425.2; 141/81

[58] Field of Search ..... 141/67, DIG. 1, 81, 141/392; 175/20, 245, 313; 73/421 R, 425, 425.2; 292/251.5; 285/9 M; 403/DIG. 1; 425/78, 804, DIG. 1; 83/123, 124, 128

[56] References Cited

U.S. PATENT DOCUMENTS

| | | | |
|---|---|---|---|
| 291,925 | 1/1884 | Morton | 285/9 M X |
| 2,896,444 | 7/1959 | Forman et al. | 73/425.2 |
| 3,181,895 | 5/1965 | Cator | 285/9 M X |
| 3,190,160 | 6/1965 | Armacost | 83/128 |
| 3,273,930 | 9/1966 | Gottfried | 73/425.2 X |
| 3,412,814 | 11/1968 | Rosfelder | 73/425.2 X |
| 3,847,191 | 11/1974 | Aronson | 141/67 X |

*Primary Examiner*—Stanley H. Tollberg
*Assistant Examiner*—Fred A. Silverberg
*Attorney, Agent, or Firm*—Pollock, Vande Sande & Priddy

[57] ABSTRACT

The dosing device, particularly adapted for filling gelatine capsules with measured amounts of pharmaceutical materials, comprises a tubular housing which is vertically movable up and down. To the lower end of said housing where there is secured a hollow punch, inside which there is slidably mounted an ejecting piston. The piston rod extends with its upper end into the tubular housing and is operatively connected to an actuating rod, axially movable at the interior of said housing, through a magnetic type connection. To this purpose, the lower end of the actuating rod is provided with a permanent magnet, while the upper end of the piston rod is provided with a pastille or disc made of ferromagnetic material. The disassembly of the piston rod from the actuating rod takes place by simply detaching the two parts, with minimum effort.

3 Claims, 2 Drawing Figures

DOSING DEVICE

BACKGROUND AND SUMMARY OF THE INVENTION

The present invention relates to a dosing device of the type comprising a hollow punch which is dipped into the material to be dosed, thus taking a predetermined metered amount of such material, and subsequently discharging said metered amount inside a suitable container. More particularly, but not exclusively, the dosing device according to the present invention is used for the filling of gelatine capsules with a measured amount of a pharmaceutical substance.

There are known dosing devices which substantially comprise a tubular housing vertically movable up and down, a hollow punch secured to the lower end of said housing, an ejecting piston carried by a suitable piston rod and axially slidable at the interior of the hollow punch, and an actuating rod connected by its lower end to the upper end of the piston rod, so as to control the vertical movement of said piston inside the hollow punch. Usually, the connection between the lower end of the actuating rod and the upper end of the piston rod is obtained by screw means. For example, the upper end of the piston rod may be externally threaded and the lower end of the actuating rod correspondingly internally threaded.

The mentioned dosing devices, however, have the disadvantage that, whenever it is desired to disassemble the piston (and piston rod) from the dosing device, it is necessary to screw off the piston rod from the actuating rod, and this operation, particularly in the automatic machines containing a great number of dosing devices, requires time and skill, since an improper screwing operation may prejudice the exact positioning (centering, axial displacement) of the ejecting piston at the interior of the hollow punch. Disassembly of the piston from the actuating rod may be required for various reasons, such as replacement of a damaged piston, cleaning all the pistons of a machine, replacement of the entire set of pistons and hollow punches with another set having different dimensions.

According to the invention, there is provided a dosing device in which the connection between the lower end of the actuating rod and the upper end of the piston rod is a magnetic type connection. According to a preferred embodiment, a permanent magnet is provided at the lower end of the actuating rod there is provided a permanent magnet, while a pastille or disc of ferromagnetic material is provided at the upper end of the piston rod.

In this manner, the piston rod can be disassembled from the actuating rod simply by detaching the said two parts, with minimum effort, while their connection during the operation of the device is safely assured. Still in accordance with the invention, the contacting surfaces of the magnetic connection are constructed as flat surfaces, so that sliding of one surface relative to the other is permitted, thus assuring self-centering of the piston rod at the interior of the hollow punch, even in case of non-alignment of the axis of the tubular housing and of the said hollow punch.

The above and other objects of the invention will apprear from the following description of a preferred embodiment thereof, made with reference to the attached drawings.

DESCRIPTION OF THE PREFERRED EMBODIMENT

Figure 2:
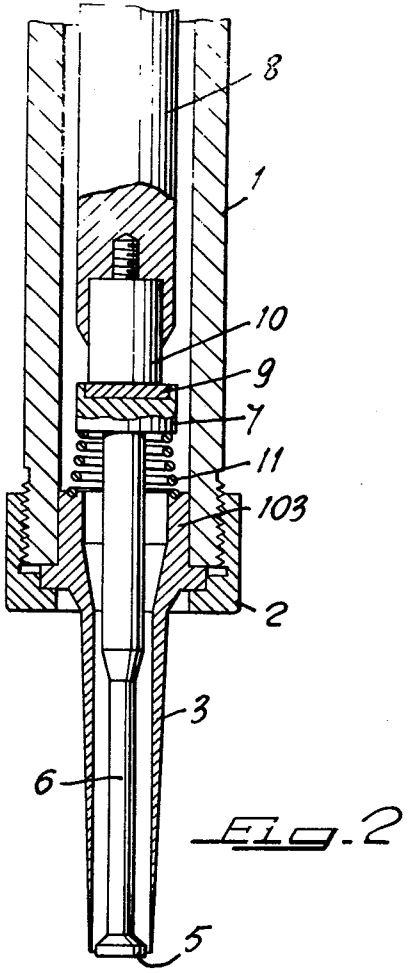
FIG. 2 is a longitudinal section of the dosing device of FIG. 1, with its ejecting piston in its fully lowered position.

With reference to the drawings, the dosing device according to the invention comprises a vertical tubular housing 1 capable of moving up and down under the action of suitable control means (not illustrated) of any type well known in the art. To the lower end of the housing 1 there is secured, by means of a locking ring nut 2, a tubular hollow punch 3 having a top end portion 103 which is inserted into the bottom end of housing 1, thus providing an annular step at the interior of the housing near its bottom end. Preferably, the cylindrical cavity of the tubular hollow punch 3 has a circular section. At the interior of the hollow punch 3 there is slidably arranged, for upward and downward axial movement, an ejecting piston 5, provided at the lower end of a rod 6. At the interior of the housing 1 there is arranged for upward and downward axial movement an actuating rod 8. Vertical movement of said actuating rod is controlled by suitable means (not shown) e.g., cam means and return springs, or as shown in U.S. Pat. No. 4,062,386.

The connection between the upper end of the piston rod 6 and the lower end of actuating rod 8 is obtained through magnetic adhesion. More particularly, the upper end of piston rod 6 has an enlarged head 7, which presents on its upper surface a circular recess inside which there is secured an adhesion disc or pastille 9 made of ferromagnetic material. As a consequence, piston rod 6 and ejecting piston 5 can be made of any suitable non-magnetic material such as light metal or plastic. At the lower end of the actuating rod 8, there is provided a permanent magnet 10, which attracts adhesion disc 9 and therefore connects the piston rod to the actuating rod.

The contacting surfaces of permanent magnet 10 and of adhesion disc 9 are constructed as flat surfaces which are perpendicular to the longitudinal axis of actuating rod 8 and to the longitudinal axis of piston rod 6, so as to permit relative displacement, by sliding movement, of the said two surfaces. Consequently, self-centering of the piston rod 6, at the interior of the cylindrical cavity of punch 3, is possible with a small amount of sliding of the surface of disc 9 on the contacting surface of magnet 10, without any variation of the connecting magnetic force.

The feasibility of such self-centering is very important, since it may happen that the longitudinal axis of the cylindrical cavity of hollow punch 3 is not aligned with the longitudinal axis of actuating rod 8. Such non-alignment is very objectionable in the case of screw connecting of the rod 6 and of the rod 8, since it necessarily leads to a frictional engagement of a portion of the side of piston 5 with the side surface of the cavity of punch 3, with consequent wear.

Figure 1:
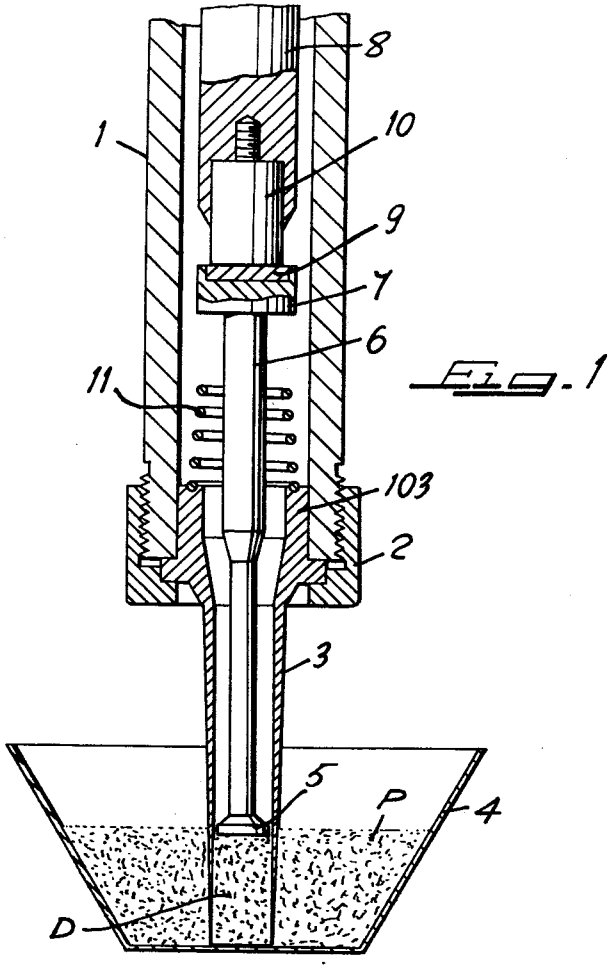
FIG. 1 is a longitudinal section of a dosing device according to the invention, with its hollow punch dipped into the material to be dosed, and with the ejecting piston in its lifted position.

At the interior of housing 1 there is arranged a helical spring 11, which bears with its lower end against the annular step provided by the upper end portion 103 of punch 3, and extends up to a certain height in the direction of the enlarged head portion 7 of piston rod 6, with which it is intended to cooperate, although upper end does not reach the said head portion 7 when the piston 5 is in the lifted or retracted position shown in FIG. 1.

Spring 11 acts as a buffer element which is elastically loaded during the final portion of the descent of piston 5 at the interior of the cavity of punch 3 (see FIG. 2) and which concurs to the subsequent lifting of the said piston 5 after discharge of the dosed material, lifting which is controlled by actuating rod 8. The additional lifting force provided by spring 11 prevents possible detachment of the contacting surfaces of disc 9 and of magnet 10 due to increased friction conditions which the piston 5 encounters at the beginning of its ascending or return run, as a consequence of the possible presence of particles of dosed material on the wall of the cavity of punch 3.

The operation of the just described device is evident. Referring to FIG. 1, the hollow punch 3, with the piston 5 retracted in its lifted position to a predetermined height, is dipped into a container 4 containing the material P to be dosed (in the present case a pulverulent material). Punch 3 is dipped a predetermined amount so that a metered dose D of material P fills the cavity up to piston 5. Dose D can then be compacted by pressing it with the said piston 5, e.g., against the bottom of the container 4, and then the dose D contained in hollow punch 3 is transferred above an empty open gelatine capsule, into which it is deposited by causing the downward descent of the ejecting piston 5 to the position shown in FIG. 2. The cycle then can be repeated. It is to be noted that, as above mentioned, during the initial length of its ascending or return stroke, the piston 5 is lifted due to the combined action of the upward movement of actuating rod 8 (connected through the magnetic connection to piston rod 6) and of the upward thrust furnished by spring 11.

Whenever it is desired to disassemble the dosing device either for cleaning purposes, or for substituting one or more parts (change of diameter of the piston and cavity, substitution of a damaged piston, etc.) the locking ring nut 2 is screwed off, and the punch 3 is removed from the tubular casing 1, while rod 6 is simply detached from the actuating rod 8, by overcoming the attractive force of magnetic connection 9, 10. The reassembly of the disassembled parts is as simple and evident and need not to be described.

From the above description, it appears evident that numerous changes and modifications, particularly in the constructive details, are possible, without departing from the spirit of the invention. Thus, disc 9 can be a permanent magnet, while element 10 may be made of ferromagnetic material; the permanent magnet 10 can be substituted by an electromagnet; suitable grooves or projecting portions and recesses may be provided in the contacting surfaces of disc 9 and of magnet 10, so at to permit rotary coupling of rods 8 and 6, as maybe desired in certain types of dosing devices. In the latter case, a certain side clearance will be provided between the grooves and the corresponding recesses, in order to permit self-centering of the piston rod 6, as above described.

Moreover, it is to be noted that the dosing device, illustrated in connection with the dosing of pulverulent material, can also be used for the dosing of dense, pasty substances, as for example disclosed in applicant's U.S. Pat. No. 4,062,386.

I claim:

1. A dosing device, particularly for the filling of capsules with a pharmaceutical substance, comprising (a) a tubular housing movable vertically up and down;

(b) a hollow punch having a cavity therein and removably secured to the lower end of said tubular housing;

(c) a piston slidably movable within said cavity said piston being provided at the lower end of a piston rod the upper end of which extends inside said tubular housing.

(d) an actuating rod vertically movable at the interior of the tubular housing and capable of contacting with its lower end the upper end of said piston rod, thereby imparting vertical movement to said piston rod;

(e) a permanent magnet at at least one of the contacting ends comprising the lower end of said actuating rod and the upper end of said piston rod;

(f) said contacting ends of the actuating rod and of the piston rod being flat horizontal surfaces, whereby relative sliding movement is permitted between the said surface while maintaining the magnetic connection between them.

2. A dosing device according to claim 1, in which the permanent magnet is arranged at the lower end of the actuating rod, while the contacting end of the piston rod is made of ferromagnetic material.

3. A dosing device according to claim 1, including a helical spring located in the lower end of said tubular housing on said upper end of said piston rod extending inside said housing, said spring being compressed, during the final portion of the descending stroke of the piston rod, between an annular step provided in correspondence of the lower end of the tubular casing and an enlarged portion provided in correspondence of the upper end of the piston rod.

* * * * *